US007207721B2

(12) United States Patent
Wu et al.

(10) Patent No.: US 7,207,721 B2
(45) Date of Patent: Apr. 24, 2007

(54) ADJUSTABLE BEARING

(75) Inventors: Xiangming Wu, Shanghai (CN); Hongwei Zhou, Shanghai (CN); Lingen Huang, Shanghai (CN)

(73) Assignee: Shanghai Maglev Transportation Development Co., Ltd., Shanghai (CN)

( * ) Notice: Subject to any disclaimer, the term of this patent is extended or adjusted under 35 U.S.C. 154(b) by 616 days.

(21) Appl. No.: 10/488,539

(22) PCT Filed: Aug. 19, 2002

(86) PCT No.: PCT/CN02/00570

§ 371 (c)(1),
(2), (4) Date: Mar. 4, 2004

(87) PCT Pub. No.: WO03/021043

PCT Pub. Date: Mar. 13, 2003

(65) Prior Publication Data

US 2004/0234177 A1 Nov. 25, 2004

(30) Foreign Application Priority Data

Sep. 4, 2001 (CN) ..... 01 1 26627

(51) Int. Cl.
*E01D 19/04* (2006.01)

(52) U.S. Cl. ..... 384/40; 248/288.51; 403/90

(58) Field of Classification Search ..... 384/36, 384/40; 248/288.51; 403/90, 91, 92, 101
See application file for complete search history.

(56) References Cited

FOREIGN PATENT DOCUMENTS

EP 0943736 A2 9/1999

*Primary Examiner*—William C. Joyce
(74) *Attorney, Agent, or Firm*—Rabin & Berdo, P.C.

(57) ABSTRACT

An adjustable bearing composed of top plate, top seat, ball hinge, stud, locking nut, stud seat and locking screw, the adjustable bearing of the invention can be steplessly adjusted vertically and horizontally, making the installation, replacement and adjustment more convenient, it has the special feature of low compression deformation, high precision, low cost and maintenance-free.

9 Claims, 5 Drawing Sheets

ADJUSTABLE BEARING

FIELD OF THE INVENTION

The invention generally relates to an adjustable bearing and especially relates to an adjustable bearing used for the girder of the viaduct, as well as the guideway girder for track-bound vehicle and the magnetic levitation (magelv) train.

BACKGROUND OF THE INVENTION

The both ends of the girder of the guideway must be respectively equipped with a bearing. All the girders of the guideway have to be aligned and adjusted in assembling and maintenance. The alignment and the adjustment may be carried out by adjusting the bearing; usually the position adjustment of the bearing is operated by inserting some steel flat liners and a steel wedge into between the adjusting holes on the lower hem of bearing and anti-shear tenon of bearing bottom plate. But inconvenience in operation, requiring a lot of work and high cost, and jamming of the steel wedge liner are the disadvantages of the aforesaid method. Moreover, the adjusting wedge can not be retreated when there is an inaccurate or incorrect adjustment.

When the modern high-speed track-bound system is used for the high-speed running of maglev train, the system has an extremely high accuracy requirement on the structure of track. It is demanded that the deformation and the deflection caused by temperature difference and dynamic load of track must be controlled within a very small range. In high speed running of the modern high speed maglev train, etc., the loads, inclusive of the self-weight of the superstructure of the guideway, are all transferred to the substructure of the guideway through bearing. In the meantime, as to the bearing itself as a part of the guideway, its deformation or displacement due to the action of external forces and temperature is superposed and accumulated on the guideway and it will produce a disadvantageous effect on the high speed running of the track-borne transportation. These small deformation or displacement will not cause any problems on the traditional bridge structure and etc, but as for the guideway used for the running of the track borne vehicle of the modern high speed transportation, especially for the guideway of the maglev train, these small deformation will negatively affect the high speed running of the train. Meanwhile, as time goes on, the foundation settlement will unavoidably occur due to the action of the gravity force applied on the substructure of the guideway, especially under the condition of the soft soil ground, this settlement will become relatively big; and the settlement of the lower structure, especially the unequal settlement between two adjacent columns, will cause the guideway superstructure to be displaced or sidewise dislocated. As for the high speed track borne transportation system, such as maglev train, the aforesaid displacement or sidewise dislocation can not be admitted absolutely. When the train runs after a time, if the magnitudes of the deformation and the deflection of the guideway caused by the settlement are very large and exceed the maximum allowable values, usually a correction of the guideway must be done by adjusting bearing. Namely, the track borne transportation, especially the modern high speed maglev train and etc. puts forward a quite higher requirement on the bearing of the guideway girder.

CONTENTS OF THE INVENTION

For overcoming the aforesaid shortcoming of the prior art, the problem need to be solved by the invention is to provide an adjustable bearing, which must have a function able to be steplessly adjusted in lateral and vertical direction with high accuracy; it also must be convenient in assembly, replacement and adjustment, of low compression, high accuracy and no maintenance.

The technical plan for solving the aforesaid problems is as follows:

An adjustable bearing which has the following special features:

It is mainly composed of the top plate, the top seat, the ball hinge, the stud, the stud bottom seat, the locking nut and the locking screw. The stud seat is a hollow cylindrical holder with flange at its bottom and threads on its inner wall. On the top surface of the hollow cylindrical holder are equally disposed at least two threaded holes for receiving screws; on the flange are equally disposed several elongated positioning apertures. The outer threads of the stud are matched with the inner threads of the stud seat, thus the stud may be screwed into the stud seat at a position of height within a certain range. At the upper end of the stud is disposed a central recess and on the outside wall at the upper portion of the stud is disposed an inserting hole for adjustment. The inner threads of the locking nut can be engaged with the outer threads of the stud, thus the locking nut is able to screw onto the stud. The screw holes disposed on the locking nut, corresponding to the threaded holes disposed on the hollow cylindrical holder (i.e. the stud seat) are provided for turning the locking bolts in order to keep the locking nut and the stud in a locking connection. An upper block having a convex spherical surface at the central portion of its lower end is inlaid with the recess at the lower central portion of the top seat, and a lower bearing seat having a concave spherical surface pit is set in a recess at the central portion of the upper end of the stud. The spherical crown of the aforesaid upper block may be just put into and engaged with the spherical bowl formed by the concave spherical surface pit of the aforesaid lower bearing seat to become a ball hinge. The top plate is placed on the top seat;

A high-abrasive and self-lubricating material is inlaid between the said upper block and the said lower bearing seat;

The said stud is a hollow cylindrical stud;

The bottom plate is also equipped. On the lower surface of the bottom plate are welded with the round-head weld-nails and correspondingly disposed the positioning holes. The said stud seat is connected with the bottom plate by the high strength bolts through their respective elongated positioning aperture on the flange of the stud seat and positioning threaded hole;

The said bottom plate and the said top plate are of square or rectangular shape;

Between the said top plate and the said top seat are the upper sliding plate made of stainless steel for fixing with the top plate and the lower sliding plate made of high-abrasive self-lubricating material. This makes the twin-directional movement between the top plate and the bottom seat to be quick and convenient;

Along two opposite sides of the bottom surface of the said top plate is respectively formed a rib which makes the section of the bottom surface to be of Π-shape, thus the said top seat, the said upper sliding plate and the said lower sliding plate all are nested therein to cause the top plate relative to the top seat to be in a single-directionally movable state;

Between the said positioning threaded hole and the said high strength bolt is set in a threaded sleeve; the threads on the outer wall of the threaded sleeve is matched with the inner threads of the positioning threaded hole and the inner threads on the inner wall of the threaded sleeve is matched with the outer threads of the high strength bolt;

The said top plate and the said top seat are furnished with the corresponding threaded holes which can be connected with screws on the said top plate.

Comparing with the prior art, the adjustable bearing of the invention has the following advantages:

1. By introducing a structure of screw-type into the construction of the bottom seat of the bearing, the bearing is designed into two parts: a separable stud and a bottom seat for the stud. The bearing can steplessly be adjusted by rotating the stud to the required height along the vertical direction in a certain range. Therefore, after the guideway for modern high-speed vehicles such as the maglev train and etc. has been operated for a certain period of time, if unequal settlement of the lower structure occurs due to the geologic influence, the guideway may be re-adjusted to its accurate position through the aforesaid stepless adjustment of the bearing. On the stud are disposed some inserting holes for adjustment. At the time of adjustment, the height can be conveniently corrected by inserting the adjusting handle into the inserting hole and adjust the bearing to a required height.

2. After the vertical adjustment is completed, the bearing can be locked to the required position by the locking device for the vertical height adjustment. The invention creatively uses a locking nut in the design of the locking structure, and uses the locking screws to lock the locking nut with the stud seat tightly. In the design, it has been specially considered that the compressive force and pressure from the upper structure is in the same direction, thus the adoption of a smaller compressive force can prevent the loosening of the height adjusting device caused by the impact and vibration of the train and etc.

3. The invention adopts the structure of separating the height adjusting stud from the ball hinge, making the bearing structure to be more reasonable. It reduces the difficulty of processing and raised the processing efficiency and suitable materials may be selected for them. In case some parts are damaged after some years, the damaged parts may conveniently be replaced by new ones without replacing a whole bearing, in so doing, the maintenance cost can also be reduced.

4. Because a separate structure is adopted for the stud seat and the bearing bottom plate, and the bottom plate is connected by the bolts through the elongated positioning apertures on the stud seat, the lateral displacement of the guideway caused by unequal settlement of the substructure can be adjusted. After the guideway is used for a period of time and a lateral displacement at the certain guideway section occurs, the lateral displacement can be corrected by loosening the relevant bolts and move the position of the bearing bottom along the lateral direction, then re-tightening the bolts of the stud seat and the bottom plate.

5. The ball hinge composed of the upper and lower ball seats can keep the lower bearing bottom plate horizontal and enable the upper top plate and sliding surface of bearing to rotate for any angular degrees within a certain range. Such a structure can meet the need of any track curvatures and satisfy the rotating requirements either on the vertical plane or the horizontal plane, needless to place the bearings in an inclined way. In the meantime, the angular deflection caused the fabrication error of the guideway girders and the substructure can also be eliminated of its own accord. As a result, the requirements on the guideway structural accuracy and the bearing installation accuracy are decreased correspondingly.

6. The invention adopts the horizontal sliding surface located on the upper spherical seat of the ball hinge. Its advantage is that the sliding surface of single-direction or double-direction slide bearings can be kept parallel with the bottom of the guideway girder without placing the bearing body in an inclined way. When the guideway girder expands or contracts due to temperature change, ends of two adjacent girders can be kept connected horizontally. This is absolutely necessary for a guideway of high-speed track-borne transportation such as the maglev train. However, this advantage is not available for bearings which place the horizontal slide surface at below the ball seat.

7. To keep a smooth connection of two adjacent guideway girders, the bearings are always placed in an inclined way in the past so as to keep the slide surface parallel with the bottom of the guideway. Such a measure has its own disadvantage that it is very difficult to adjust the dislocation of guideway girders caused by the settlement of substructure, because in general conditions such settlement is tend to be vertically downward under usual circumstances. The height adjustment of an obliquely-placed bearing is generally along the centerline of bearing, i.e. the direction of the obliquely-placed bearing. The two directions has a certain included angle which brings an horizontal error after correcting the vertical error by adjusting the height of the bearing. The invention overcomes such a difficulty.

8. In the invention, a material of low compression, high abrasion and self-lubrication is adopted in between the friction surfaces of ball hinge and the plane. It can avoid a direct friction between metals and lower the requirement on material selection for the friction pair and meet the requirements on a track of low compressive deformation and long service life for a high-speed track borne transportation system.

To sum up, the adjustable bearing of the invention can be steplessly adjusted vertically and horizontally, making the installation, replacement and adjustment more convenient. It has the special feature of low compression, high precision and free from maintenance. It can meet the need of compensating the errors caused by uniform or un-uniform settlement of the guideway substructure. The adjustable bearing makes it possible to build a high-speed track-bound transportation system, especially a maglev guideway system.

BRIEF DESCRIPTION OF THE APPENDED DRAWINGS

IN THESE FIGURES

1—top plate;
111—upper sliding plate;
12—threaded hole;
2—top seat;
21—circular-shaped recess at lower end of top seat;
22—lower sliding plate;
23—threaded hole;
3—ball hinge;
31—upper block having a convex spherical surface at central portion of its lower end;
32—lower bearing seat having a concave spherical surface pit at the central portion of its upper end;
33—high-abrasive and self-lubricating material;
4—stud;
41—recess;
42—inserting hole for adjustment handle;
43—outer thread;
5—locking nut;
51—threaded hole;
52—locking screw;
6—stud seat;
61—inner threads;
62—threaded hole;
63—elongated positioning aperture;
64—flange of stud seat;
7—bottom plate;
71—threaded positioning hole;
72—threaded sleeve;
73—outer thread;
74—inner thread;
75—high strength bolt;
76—round-headed weld-nail.

DESCRIPTION OF THE EMBODIMENTS

Figure 1:
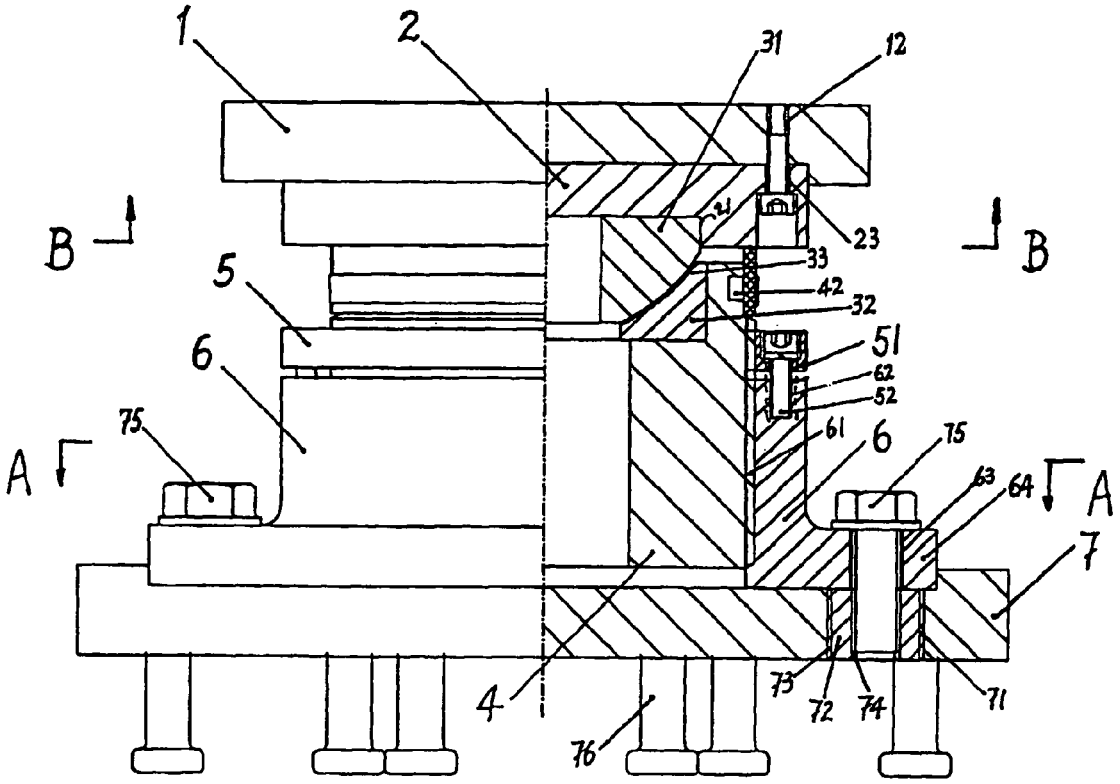
FIG. 1 is a schematic front view of the structure of embodiment 1 of the invention, but the front-right quarter thereof is cut off.
Figure 2:
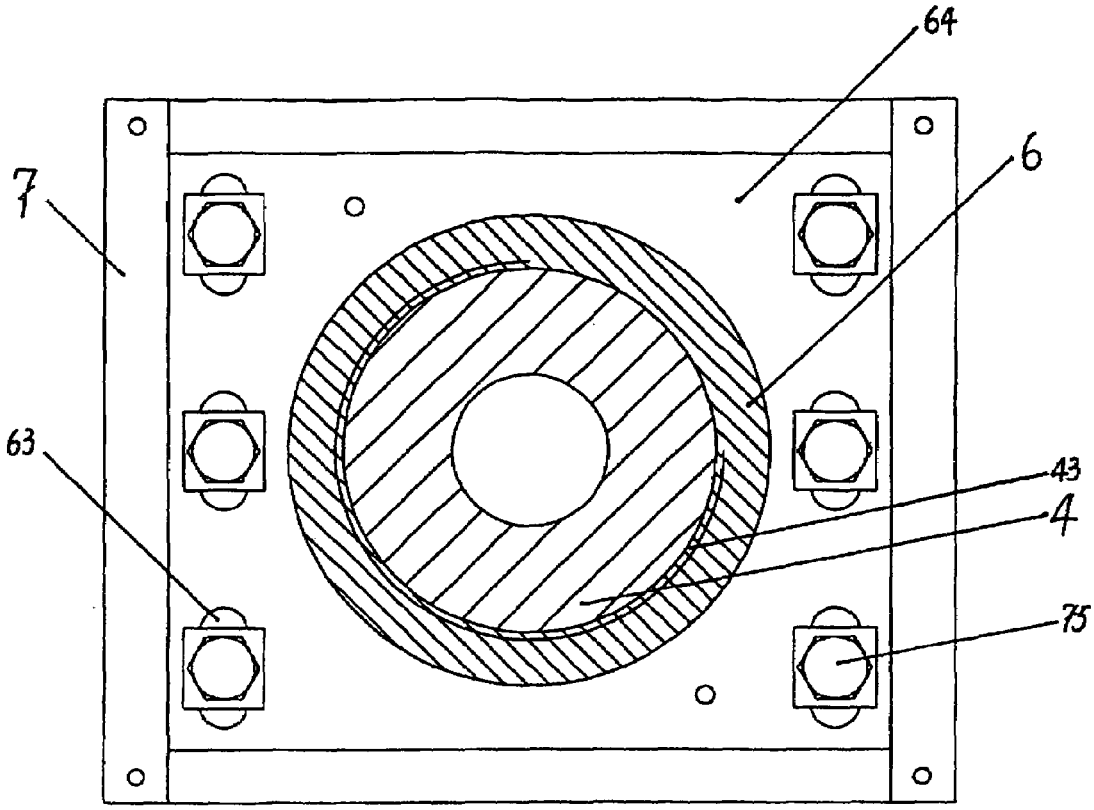
FIG. 2 is a sectional view of the structure of embodiment 1 along the line A—A in FIG. 1.
Figure 3:
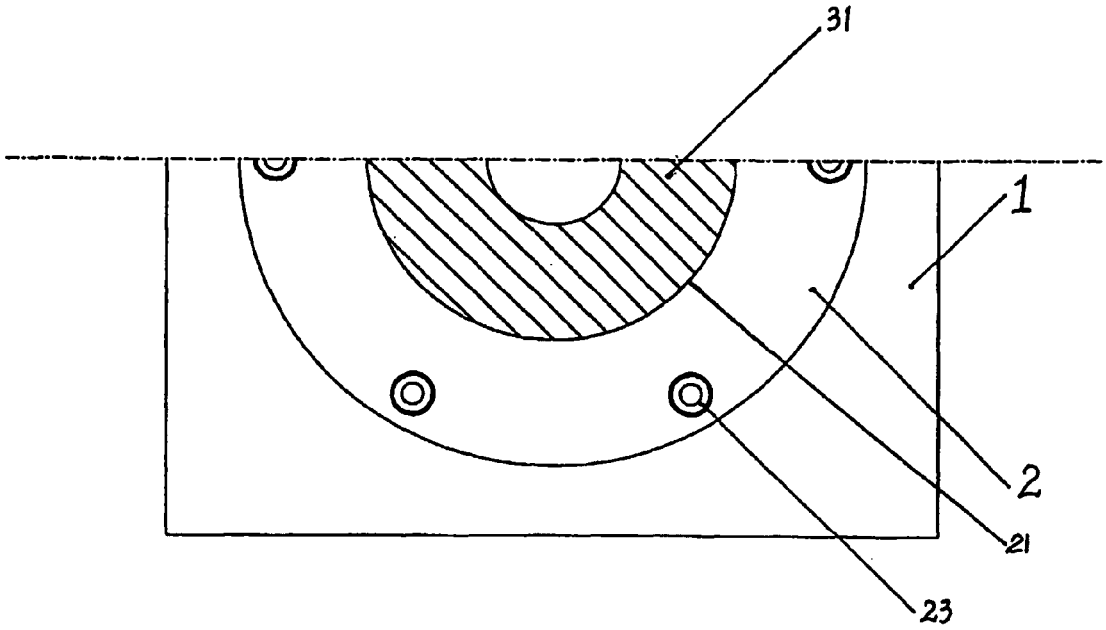
FIG. 3 is a sectional view of the structure of embodiment 1 along the line B—B in FIG. 1.

As shown in FIGS. 1, 2 and 3, the adjustable bearing of embodiment 1 of the invention is composed of the top plate 1, top seat 2, ball hinge 3, stud 4, locking nut 5, stud seat 6 and the bottom plate 7.

The stud seat 6 is a hollow cylindrical holder with flange 64 at its bottom and threads 61 on its inner wall. On the top surface of the hollow cylindrical holder are equally disposed at least two threaded holes 62 for receiving screws; on the flange 64 are equally disposed several elongated positioning apertures 63.

The outer threads 43 of the stud 4 may be engaged with the inner threads 61 of the stud seat 6, thus the stud 4 can be turned into the stud seat 6 at a position of any height within a certain range. At the central portion of the upper end of the stud 4 is disposed a recess 41 and on the outside wall at the upper portion of the stud is disposed an inserting hole 42 for adjustment.

The inner threads of the locking nut 5 can be engaged with the outer threads 43 of the stud 4, thus the locking nut 5 can be turned onto the stud. The screw holes 51 disposed on the locking nut and corresponding to the threaded holes 62 disposed on the stud seat 6 are provided for turning the locking screws 52 therein in order to keep the locking nut and the stud in a locking connection.

At the central portion of the lower end of the top seat 2 is disposed a circular-shaped recess 21 in which the upper block 31, having a convex spherical surface at the central portion of its lower end, is just inlaid; the lower bearing seat 32, having a concave spherical surface pit, is set in a recess 41 at the central portion of the upper end of the stud. The spherical crown of the said upper block 31 may be put into and engaged with the spherical bowl formed by the concave spherical surface pit of the lower bearing seat 32 to become a ball hinge 3.

The top plate is placed on the top seat;

The said bottom plate 1 is placed on the top seat 2;

Under the said stud seat 6 is disposed the bottom plate 7. On the lower surface of the bottom plate 7 are welded many of round-headed weld-nails 76 and all around the bottom plate 7 are disposed the positioning threaded holes corresponding to the elongated positioning holes 63 on the flange of stud seat 64 of the stud seat 6. The said stud seat 6 is connected with the bottom plate 7 with high strength bolts 75 through the elongated positioning holes 63 and the corresponding positioning threaded holes 71 on the bottom plate 7.

The said bottom plate 7 and top plate 1 are all of square or rectangular shape.

A high-abrasive and self-lubricating material is inlaid between the said upper block 31 and the said lower bearing seat 32;

The said stud 4 is a hollow cylindrical stud;

Between the said positioning threaded hole 71 and the said high strength bolt 75 is set in a threaded sleeve 72; the outer threads 73 on the outer wall of the threaded sleeve 72 is matched with the inner threads 74 of the positioning threaded hole 71 and the inner threads 74 on the inner wall of the threaded sleeve 72 is matched with the outer threads of the high strength bolt 75;

The said top plate 1 and the said top seat 2 are disposed corresponding threaded holes 12 and 23. This keeps the bearing as an integral in the course of transport and installation. After installation, unscrew the screws, and the bearing enters into the operation state.

Figure 4:
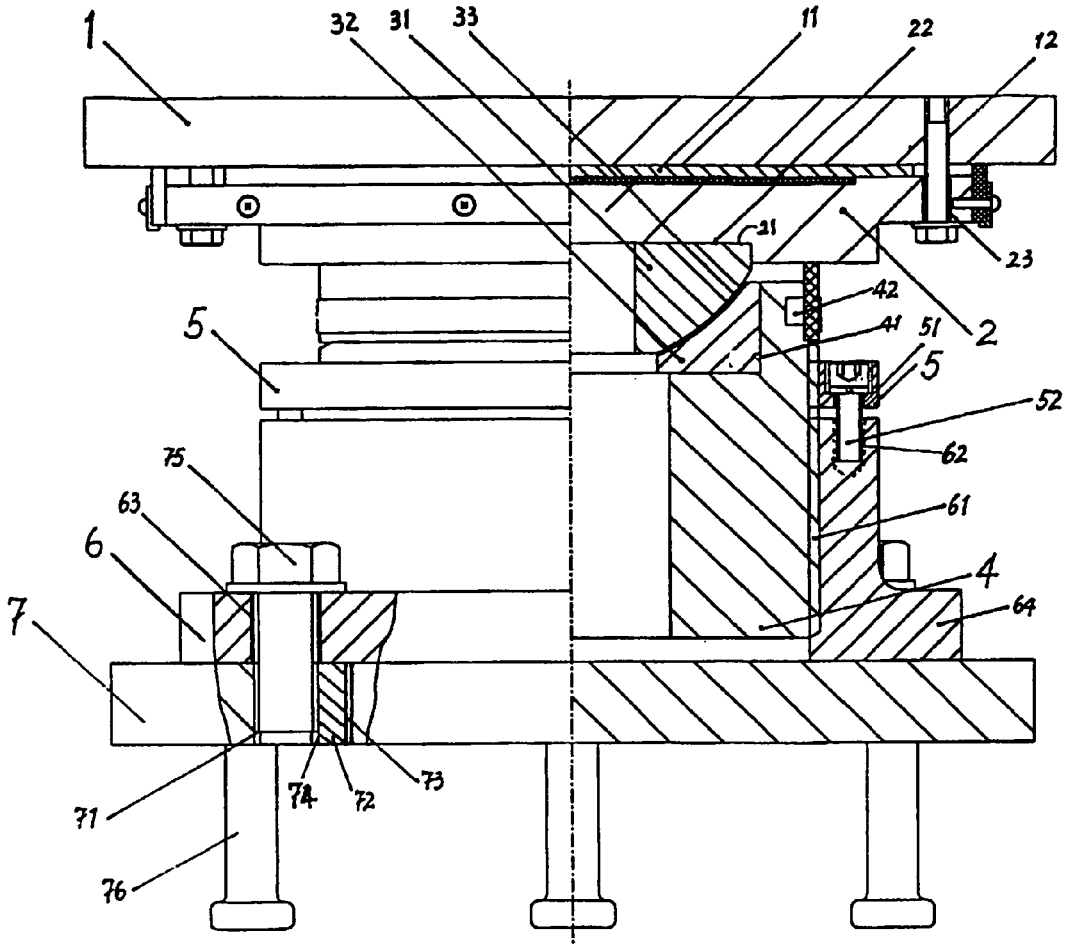
FIG. 4 is a schematic front view of the structure of the embodiment 2 of the invention, but the front-right quarter thereof is cut off.
Figure 5:
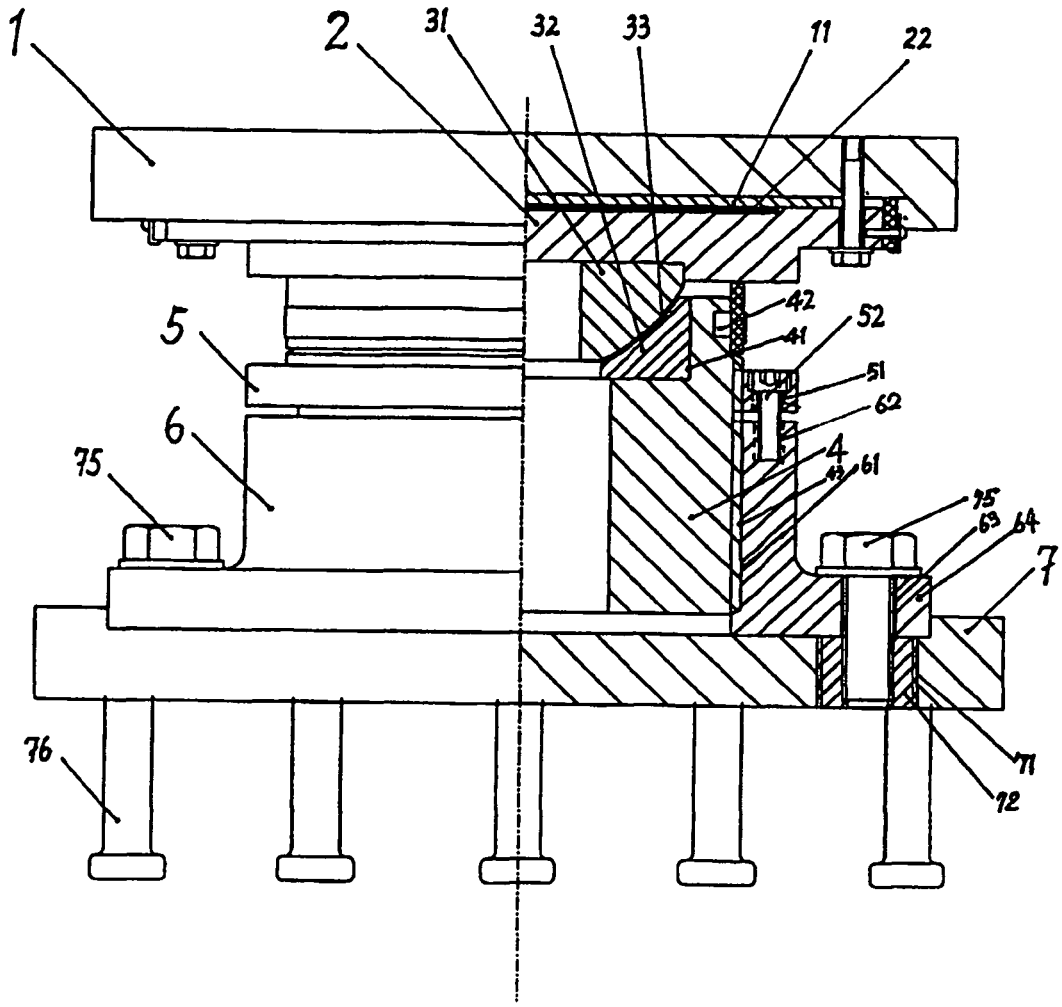
FIG. 5 is a schematic front view of the structure of the embodiment 3 of the invention, but the front-right quarter thereof is cut off.

FIG. 4 is a schematic front view of the structure of the embodiment 2 of the invention, but the front-right quarter thereof is cut off. Comparing FIG. 4 with FIG. 1, the main difference is that between the said top plate 1 and the said top seat 2 are the upper sliding plate 11 made of stainless steel for fixing with the top plate 1 and the lower sliding plate 22 made of high-abrasive self-lubricating material. This makes the twin-directional movement between the top plate 1 and the bottom seat 2 to be more convenient;

FIG. 5 is a schematic front view of the structure of the embodiment 3 of the invention, but the front-right quarter thereof is cut off. Comparing FIG. 5 with FIG. 4, the main difference is that along two opposite sides of the bottom surface of the said top plate 1 is respectively formed a rib which makes the section of the bottom surface to be of Π-shape, thus the said top seat 2, the said upper sliding plate 11 and the said lower sliding plate 22 all are nested therein to cause the top plate relative to the top seat to be in a single-directionally movable state;

In terms of function, the adjustable bearing of the invention can be considered to be composed of the following systems:

1. Vertical height adjusting and locking system: composed of stud seat 6, stud 4, locking nut 5 and locking screw 52. Inner threads 61 are processed in the cylindrical chamber of stud seat 6. Together with stud 4, they constitute the stepless vertical height adjusting device. When it is adjusted to the required height, the locking screw 52 located between the locking nut 5 and stud seat 6 may be used for locking.

2. Ball hinge system: consist of the upper ball seat 31 and the lower ball seat 32. Between the upper ball seat 31 and the lower ball seat 32 is inlaid the self-lubricating material 33 of low compressive deformation and high abrasion resistance.

The system can adjust the rotating angle of the bearing caused by vertical or horizontal cant on curves. It can also adjust the angle deviation caused by the manufacturing error of guideway girder or column cap of substructure.

3. Horizontal adjusting system: consist of stud seat 6, bottom plate 7 and high-strength bolt 75. The system adopts the structure of separating stud seat 6 from bottom plate 7. An elongated positioning aperture 63 is made in the middle of stud seat 6. The high-strength bolt 75 connects the stud seat 6 with bottom plate 7. When the bearing needs a lateral adjustment, loosen the bolt 75, then move the stud seat sidewise to an appropriate position, finally lock the bolt 75. In this way, the function of lateral adjustment of the bearing can be realized.

4. Horizontal friction pair: composed of upper slide plate 11 and lower slide plate 22. The upper slide plate 11 is welded or riveted onto the top plate 1 with stainless steel plate. The lower slide plate 22 adopts the self-lubricating material of low compression and high abrasion. A friction pair of such a structure can meet requirements of low compressive deformation, high abrasive resistance and long service life for the modern high-speed track-bound transportation.

We claim:

1. An adjustable bearing comprising of a top plate (1), a top seat (2), a ball hinge (3), a stud (4), a locking nut (5), a stud seat (6) and a locking screw (52);

said stud seat (6) is a hollow cylindrical holder with a flange (64) at its bottom and threads (61) on its inner wall, on the top surface of the hollow cylindrical holder are equally disposed at least two threaded holes (62) for receiving screws, and on the flange (64) are equally disposed several elongated positioning apertures (63);

outer threads (43) of the stud (4) are matched with the inner threads (61) of the stud seat (6), thus the stud (4) may be screwed into the stud seat (6) at a position of height within a certain range, and at the upper end of the stud (4) is disposed a central recess (41) and on the outside wall at the upper portion of the stud is disposed an inserting hole (42) for adjustment;

inner threads of the locking nut (5) being engaged with the outer threads (43) of the stud (4), thus the locking nut (5) is able to screw onto the stud, screw holes (51) disposed on the locking nut (5), corresponding to the threaded holes (62) disposed on the hollow cylindrical holder are provided for receiving the locking screw (52) in order to keep the locking nut (5) and the stud in a locking connection;

an upper block (31) having a convex spherical surface at the central portion of its lower end and is inlaid in a recess (21) at the lower central portion of the top seat (2), and a lower bearing seat (32) having a concave spherical surface pit is set in the recess (41) at the central portion of the upper end of the stud (4), the spherical surface of the aforesaid upper block (31) being engaged with a spherical bowl formed by the concave spherical surface pit of the aforesaid lower bearing seat (32) to become a ball hinge (3);

said top plate (1) is placed on the top seat (2).

2. The adjustable bearing of claim 1, characterized in that a high-abrasive and self-lubricating material (33) is inlaid between the said upper block (31) and the said lower bearing seat (32).

3. The adjustable bearing of claim 1, characterized in that the said stud (4) is a hollow cylindrical stud.

4. The adjustable bearing of claim 1, characterized in that a bottom plate (7) is provided, on a lower surface thereof, with welded round-head weld-nails (76) and correspondingly provided with positioning holes (71), the stud seat (6) being connected with the bottom plate (7) by high strength bolts (75) through the respective elongated positioning aperture (63) and the positioning threaded hole (71) of the bottom plate (7).

5. The adjustable bearing of claim 4, characterized in that the bottom plate (7) and the top plate (1) are all of square or rectangular shape.

6. The adjustable bearing of claim 5, characterized in that between the top plate (1) and the top seat (2) are equipped with an upper sliding plate (11) made of stainless steel for fixing with the top plate and a lower sliding plate (22) made of high-abrasive self-lubricating material.

7. The adjustable bearing of claim 6, characterized in that along two opposite sides of the bottom surface of the top plate (1) is respectively formed a rib which makes a section of the bottom surface, thus the top seat (2), the upper sliding plate (11) and the lower sliding plate (22) all are nested therein to cause the top plate relative to the top seat (1) to be in a single-directionally movable state relative to top seat (1).

8. The adjustable bearing of claim 4, characterized in that between the said positioning threaded hole (71) and the said high strength bolt (75) is set in a threaded sleeve (72); outer threads (73) on an outer wall of the threaded sleeve (72) are matched with the inner threads of the positioning threaded hole (71) and inner threads (74) on the inner wall of the threaded sleeve (72) are matched with the outer threads of the high strength bolt (75).

9. The adjustable bearing of claim 8, characterized in that the said top plate (1) and the said top seat (2) are provided with corresponding screw holes (12) and (23).

* * * * *